US007163409B1

(12) United States Patent
Chen et al.

(10) Patent No.: US 7,163,409 B1
(45) Date of Patent: Jan. 16, 2007

(54) MODULAR INTEGRATED SOCKET APPARATUS

(75) Inventors: Wen-Chun Chen, Tao Yuan (TW); Ming-Chih Huang, Tao Yuan (TW)

(73) Assignee: Hoolin Research Company Limited, Tao Yuan (TW)

( * ) Notice: Subject to any disclaimer, the term of this patent is extended or adjusted under 35 U.S.C. 154(b) by 0 days.

(21) Appl. No.: 11/488,701

(22) Filed: Jul. 19, 2006

(51) Int. Cl.
*H01R 13/44* (2006.01)

(52) U.S. Cl. ..... 439/131

(58) Field of Classification Search ..... 439/131, 439/378, 214, 536
See application file for complete search history.

(56) References Cited

U.S. PATENT DOCUMENTS 4,984,982 A * 1/1991 Brownlie et al. ..... 439/131
5,122,069 A * 6/1992 Brownlie et al. ..... 439/131
5,351,173 A * 9/1994 Byrne ..... 362/127
D442,143 S * 5/2001 Gershfeld ..... D13/139.4
6,234,812 B1 * 5/2001 Ivers et al. ..... 439/131
D456,357 S * 4/2002 Gershfeld ..... D13/139.4
6,416,336 B1 * 7/2002 Schulte et al. ..... 439/131
D512,964 S * 12/2005 Kissinger et al. ..... D13/139.4

* cited by examiner

*Primary Examiner*—Tulsidas C. Patel
*Assistant Examiner*—Harshad C Patel
(74) *Attorney, Agent, or Firm*—Troxell Law Office, PLLC

(57) ABSTRACT

A modular integrated socket apparatus comprises a shell, a pop-up structure, an adapter module, a connector base, and a coupling device. The pop-up structure, the adapter module, the connector base, and the coupling device are mounted in the shell. The adapter module is electrically connected to the connector base. When in use, the shell and the adapter module are located higher than the table by use of the pop-up structure and the coupling device. As a result, the purpose of adding the connector of new hardware or power source can be achieved easily.

4 Claims, 8 Drawing Sheets

MODULAR INTEGRATED SOCKET APPARATUS

FIELD OF THE INVENTION

The present invention relates to a socket apparatus, and more particularly to a modular integrated socket apparatus that integrates connectors of computer peripherals by use of an adapter module.

BACKGROUND OF THE INVENTION

Recently, with the progress of technology, the price of computer is reduced gradually. Comparatively speaking, the utilization rate of computer is popular more and more. In a general personal desktop computer, a cable connector of a newly added hardware is unavoidably inserted into a socket on the backside of the computer case, and a power connector of this newly added hardware is unavoidably additionally inserted into a power socket for supplying the required electric power.

However, the aforesaid way for adding this new hardware has the following drawbacks, wherein:

1. The computer case is typically mounted inside the computer table, and partitioned off by a board. In the process of adding the new hardware, the computer case must be moved out for insertion of the cable connector of this new hardware, resulting in the inconvenience and causing the other connectors on the computer case to fall easily.

2. The conducting wire of the new hardware is exposed to the outside so the untidiness is unavoidable when certain amounts of new hardwares are added.

3. It is not easy to operate this new hardware when the length of the conducting wire of the newly added hardware is too short. As a result, this new hardware must be located near the computer connector, resulting in the inconvenience in operating the buttons of this new hardware.

4. The connector socket of the conventional computer case cannot meet the requirement of connecting with multiple USB connectors or power connectors simultaneously, resulting in the disablement in simultaneously utilizing multiple connectors.

SUMMARY OF THE INVENTION

A major object of the present invention is to disclose a convenient, beautiful, easy-operatable, and expandable modular integrated socket apparatus.

In order to achieve the above-mentioned object and other purposes, the present invention discloses a modular integrated socket apparatus comprising a shell, a pop-up structure, an adapter module, a connector base, and a coupling device. The pop-up structure, the adapter module, the connector base, and the coupling device are mounted inside the shell. The adapter module is electrically connected to the connector base. When in use, the shell and the adapter module are located higher than the table by use of the pop-up structure and the coupling device. As a result, the purpose of adding the connector of new hardware or power source can be achieved easily.

DETAILED DESCRIPTION OF THE PREFERRED EMBODIMENT

Figure 1:
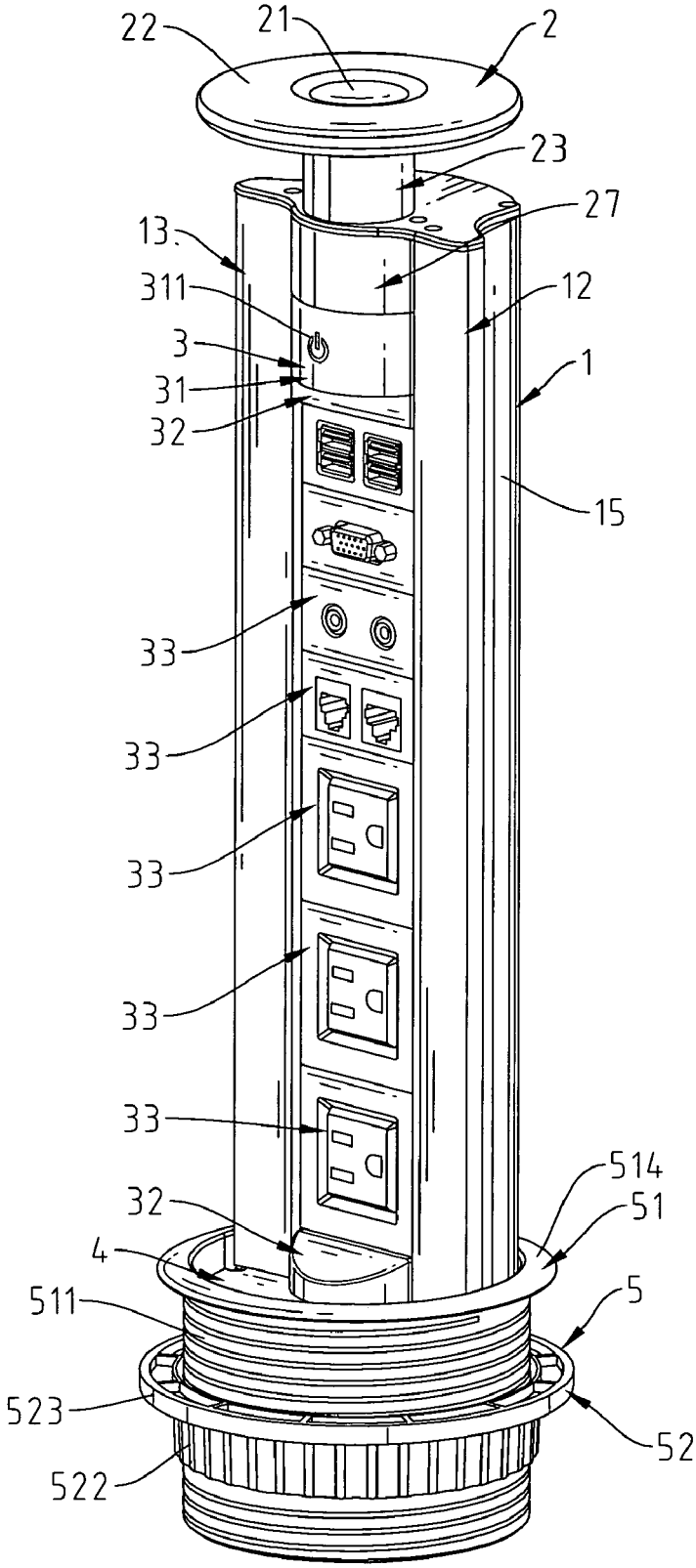
FIG. 1 is an elevational view of the present invention.
Figure 2:
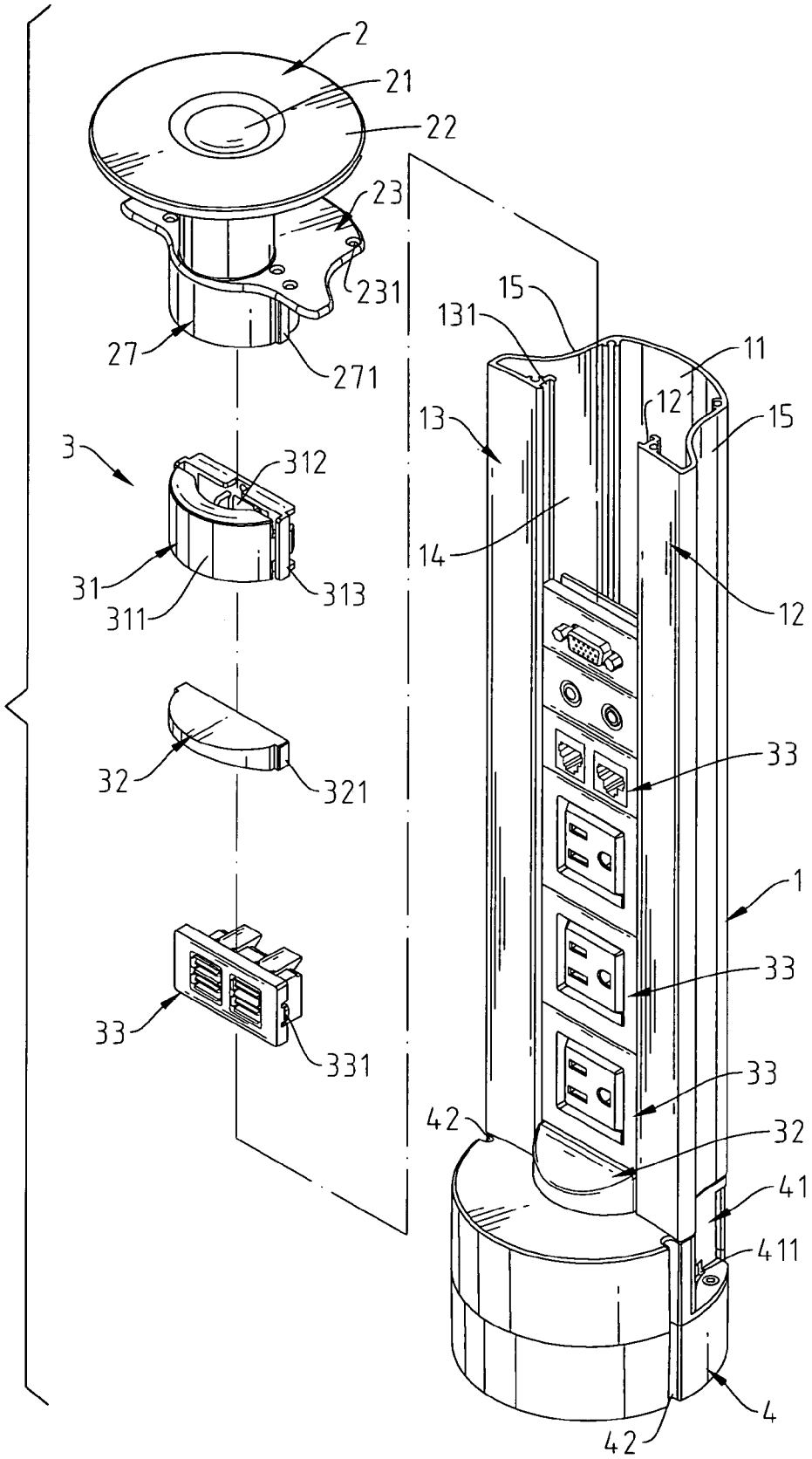
FIG. 2 is an elevational, exploded view of the adapter module of the present invention.

Referring to FIGS. 1 through 5, a modular integrated socket apparatus of the present invention comprises a shell 1, a pop-up structure 2, an adapter module 3, a connector base 4, and a coupling device 5.

The shell 1 is in the shape of a semi-cylinder, and has an opening 11 at each of both ends. One of these openings 11 is fixedly connected to the pop-up structure 2, and the other opening 11 is fixedly connected to the connector base 4. Besides, the shell 1 has two bottom portions 12 and 13 on the front surface. Two slots 121 and 131 are formed on the lateral edges of the bottom portions 12 and 13, respectively. A notch 14 is defined between the bottom portions 12 and 13 for insertion of the adapter module 3 into the notch 14 such that the adapter module 3 is held in the slots 121 and 131. The coupling device 5 is movably circularly sleeved onto the outer surface of the shell 1. At least one positioning slot 15 is inwardly formed on the outer surface of the shell 1.

The pop-up structure 2 comprises a decorative device 21, a pull device 22, a positioning trench 23, a guiding device 24, a positioning device 25, an elastic device 26, and a covering device 27. The decorative device 21 is connected to the outer surface of the pull device 22. The pull device 22 is fixedly connected to one end of the guiding device 24 via the center region of the inner surface thereof. The positioning trench 23 is sleeved onto an outer wall of the guiding device 24. The positioning trench 23 has several connection holes 231 for touching the opening of the shell 1 so as to fix and position the positioning trench 23 on the shell 1. The positioning trench 23 has several ribs 232 having respective angular slanted rearwards on an inner wall, and the positioning trench 23 further has several positioning slots 233 and several protrusions 234 among the ribs 232. The protrusions 234 are thinner than the ribs 232. The guiding device 24 has several toothed portions 241 circularly at one end on an edge of an opening thereof. The guiding device 24 has several bumps 242 circularly on the outer surface of the opening thereof, wherein the bumps 242 are respectively located between two ribs 232 for positioning the guiding device 24. The opening of the guiding device 24 is sleeved onto one end of the positioning device 25. The positioning device 25 has several positioning ribs 251 having respective angular slanted front ends at the other end on an outer wall of an opening thereof. In addition, the elastic device 26 is disposed in the opening of the positioning device 25. The bottom of the elastic device 26 is connected to the covering device 27. The covering device 27 is screwed fixedly onto the lateral surface of the positioning trench 23 via one end thereof, and the covering device 27 is inserted into the notch 14. The covering device 27 has two first retaining ribs 271 on the outer surface for being held in the aforesaid slots 121 and 131, respectively.

The adapter module 3 is a modularized assembly. The adapter module 3 comprises a power controller 31, several decorative devices 32, and several socket structures 33. The power controller 31 is electrically connected to the connector base 4 for turning on or off the power source. The power controller 31 has a pressing surface 311 on the front side. A light-emitting source 312 is mounted on the inside of the pressing surface 311. The power controller 31 has two second retaining ribs 313 on the outer surface for being held in the slots 121 and 131, respectively. The decorative devices 32 are for partitioning off and decorating the adapter module 3. Each decorative device 32 has two third retaining ribs 321 on the outer surface. These two third retaining ribs 321 are held in the aforesaid slots 121 and 131, respectively. The socket structures 33 are composed of connector sockets for computer peripherals such as monitor, microphone, speaker, network cable, USB device, power source, and so on. The socket structures 33 are electrically connected to the connector base 4, and inserted into the notch 14. Each of the socket structures 33 has two fourth retaining ribs 331 on the outer surface for being held in the aforesaid slots 121 and 131, respectively.

The connector base 4 comprises a slot 41, a positioning slot 32, and a connector unit 43. The connector base 4 has at least one slot 41 inwardly formed on the outer surface corresponding to the bottom end of the positioning slot 15. The slot 41 has a positioning hooking slot 411 at the bottom end. The connector base 4 has several positioning guiding slots 42 on the outer surface. The connector unit 43 is located on the bottom end of the connector base 4 and composed of connector sockets for computer peripherals such as monitor, microphone, speaker, network cable, USB device, power source, and so on for electrically connection with the computer peripherals.

The coupling device 5 comprises a sleeving device 51 and a gripping device 52. The sleeving device 51 is slidably sleeved onto the outer surfaces of the shell 1 and the connector base 4. The sleeving device 51 has a first threaded section 511 on the outer surface. A first fixing ring 514 is radially protrudent from one end of the first threaded section 511. The sleeving device 51 has a positioning hooking device 512 on the inner surface corresponding to the positioning hooking slot 411. The sleeving device 51 has guiding ribs 513 on the inner surface corresponding to the positioning guiding slots 42 for being placed on one side of the front surfaces of the bottom portions 12 and 13, thereby preventing the left-right rotation of the sleeving device 51. The gripping device 52 has a second threaded section 521 on the inner surface corresponding to the aforesaid first threaded section 511. The gripping device 52 is screwed onto the sleeving device 51 by use of the second threaded section 521 for fixing the coupling device 5 on the table. In addition, the gripping device 52 has several skidproof slots 522 on the outer surface. A second fixing ring 523 is radially protrudent from the top of the skidproof slots 522.

Figure 3:
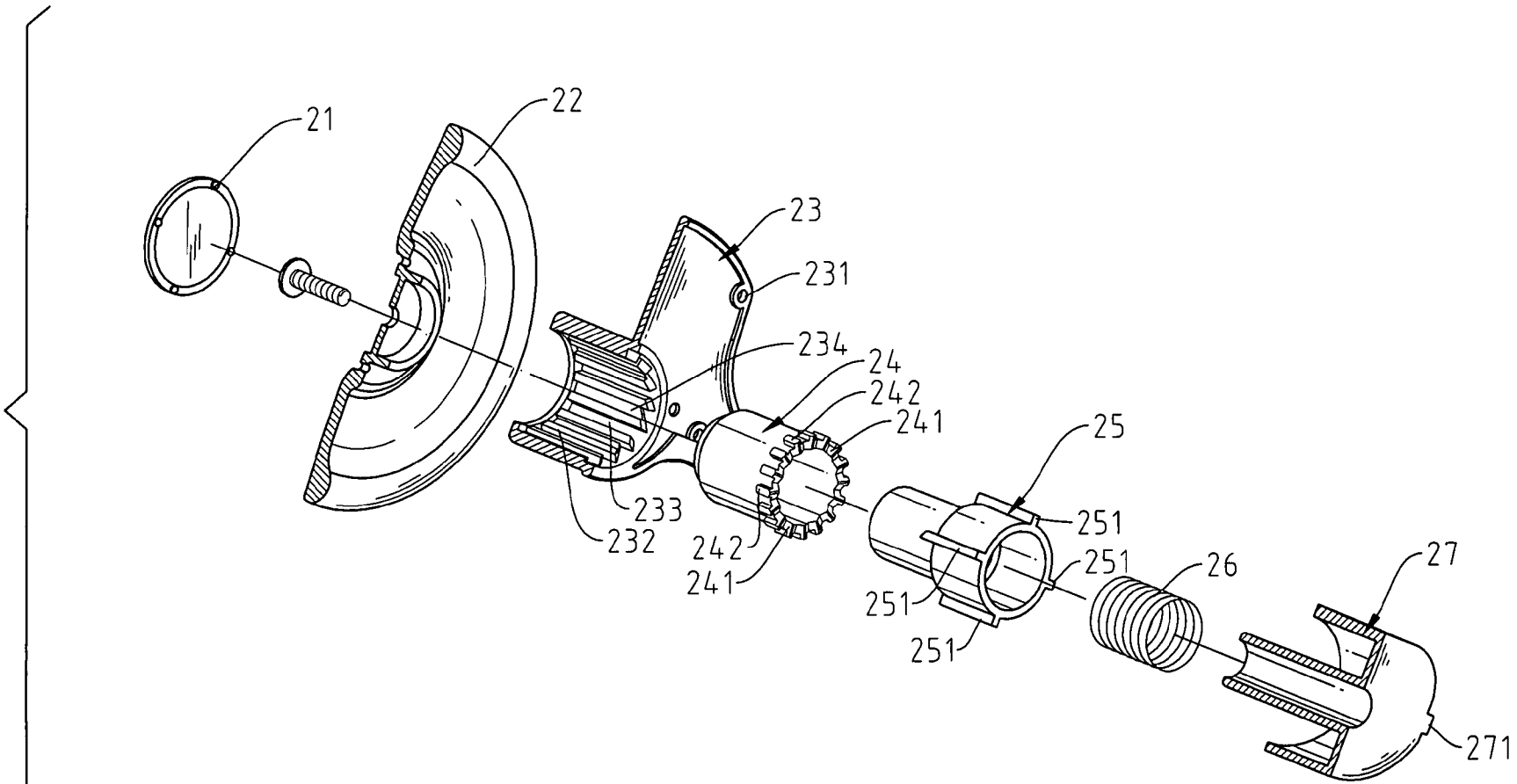
FIG. 3 is an elevational, exploded, inside view of the pop-up structure of the present invention.
Figure 4:
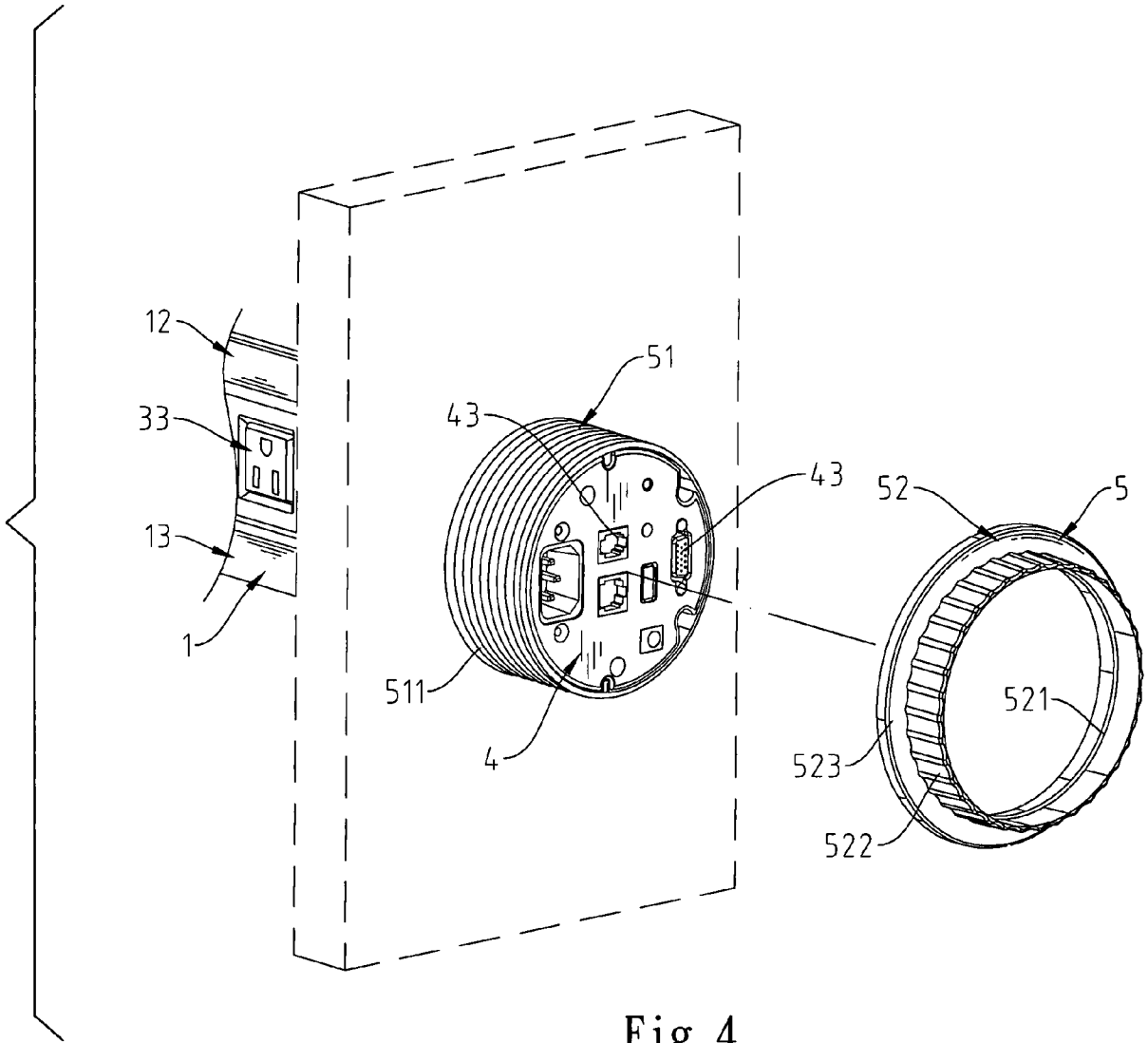
FIG. 4 is an elevational, exploded view of the coupling device of the present invention.
Figure 5:
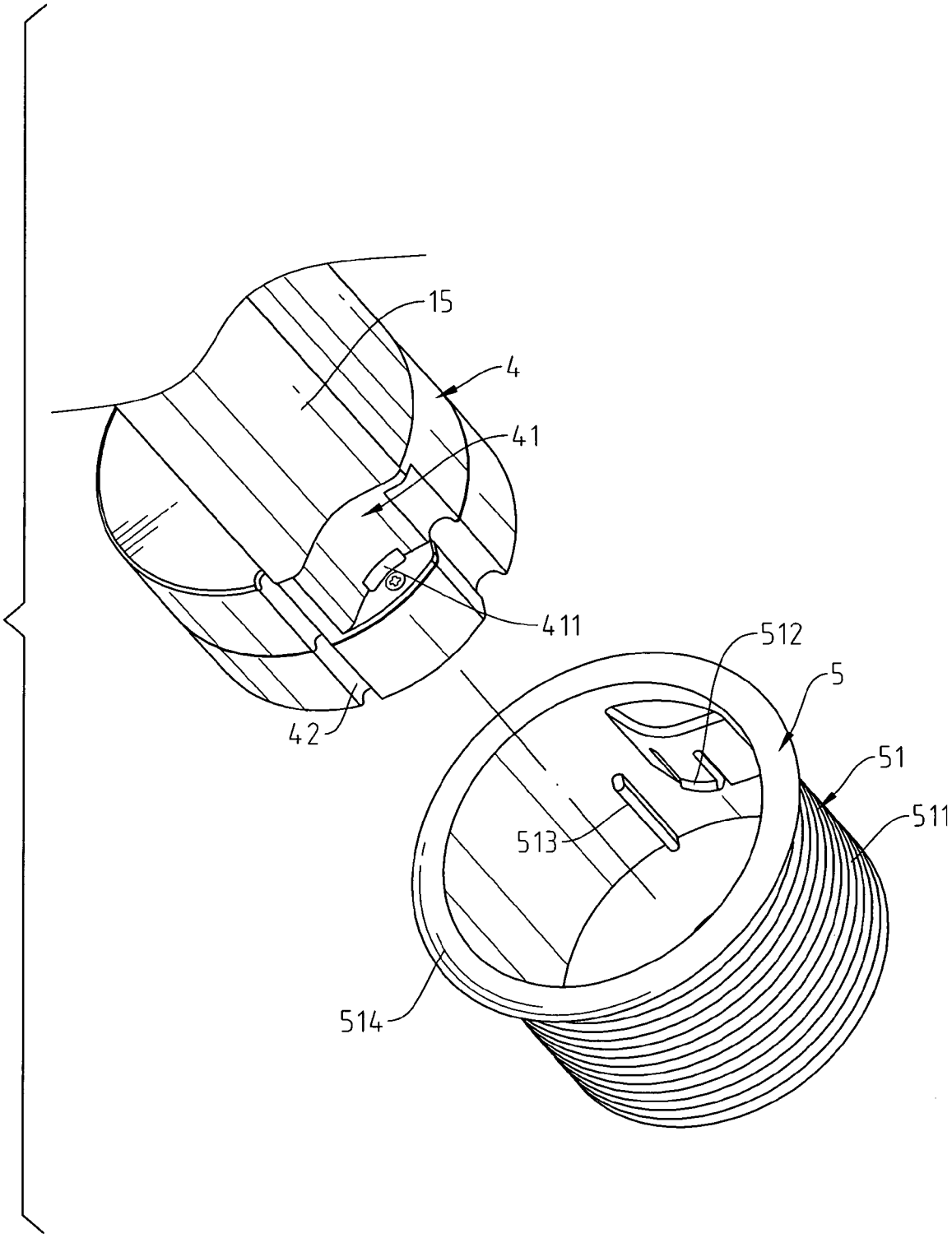
FIG. 5 is an elevational view of the connector base and the coupling device of the present invention.

Referring to FIG. 3, the exploded inside view and the motion principle of the pop-up device 2 is shown. In the pop-up structure 2 of the present invention, the elastic device 26 is utilized to apply a certain amount of force to the positioning device 25 such that the front inner sides of the positioning ribs 251 are pressed toward the toothed portions 241 without engaging with the toothed portions 241. As a result, the positioning ribs 251 are held in the positioning slots 233, respectively. At this moment, the decorative device 21 or the pull device 22 is in a raised status. When the decorative device 21 or the pull device 22 is pressed down to the bottom position, the positioning ribs 251 are separated from the positioning slots 233, and the front inner surfaces of the positioning ribs 251 are rotated by an angle to engage with the toothed portions 241. Besides, the front outer surfaces of the positioning ribs 251 are allowed to correspondingly touch the rearwards of the ribs 232. Besides, the elastic device 26 applies a certain amount of force to the positioning device 25 to allow the front outer surfaces of the positioning ribs 25 to be rotated along the angular slanted shape thereof and to be positioned at the rearwards of the protrusions 234. At this moment, the decorative device 21 and the pull device 22 are in a retraction status. By means of the aforesaid motions, the decorative device 21 and the pull device 22 of the pop-up structure 2 can be poped up or retracted.

Figure 6:
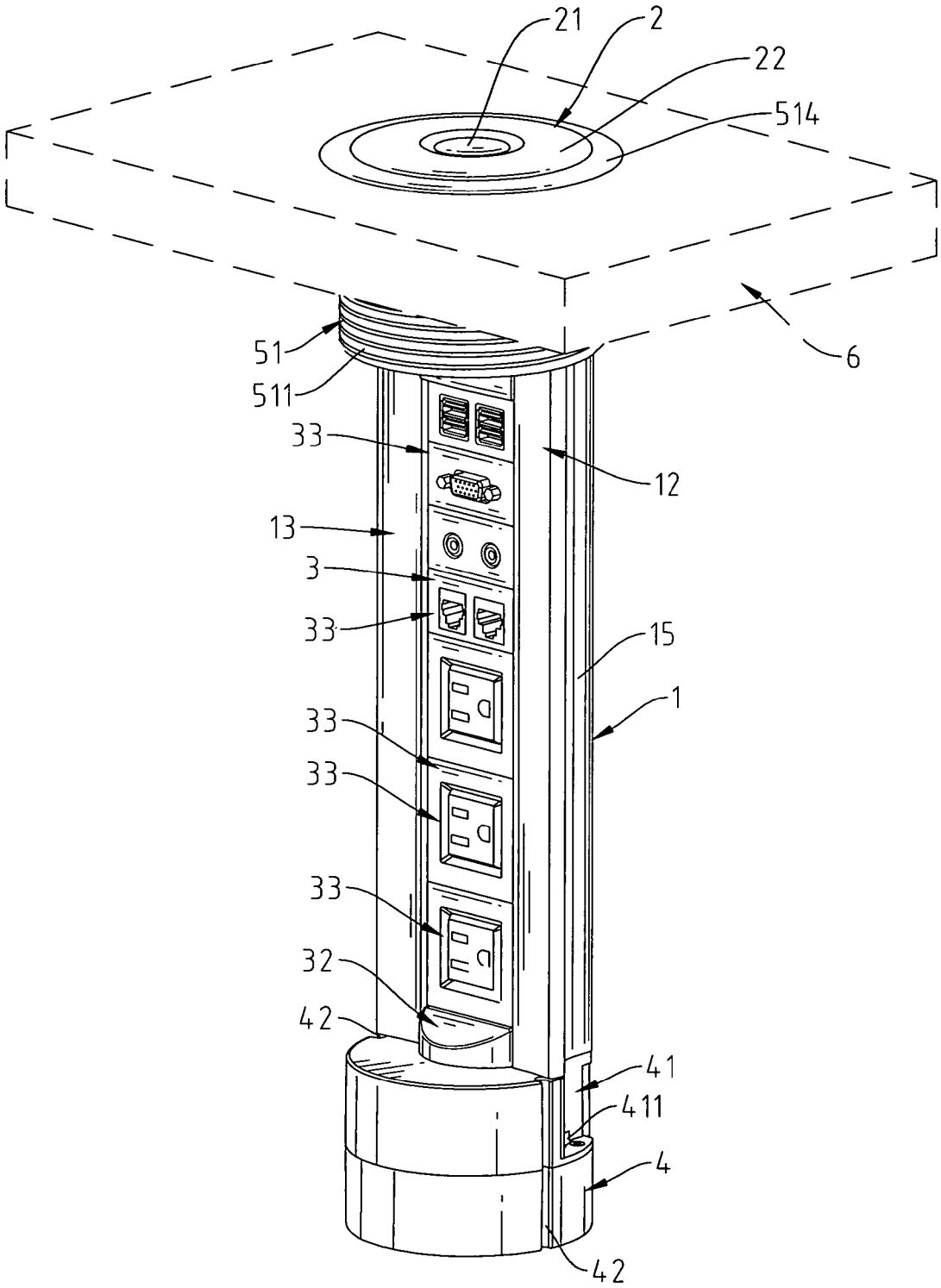
FIG. 6 is a schematic view showing the application status of the modular integrated socket apparatus of the present invention that couples with the table, wherein the pop-up structure is retracted.
Figure 7:
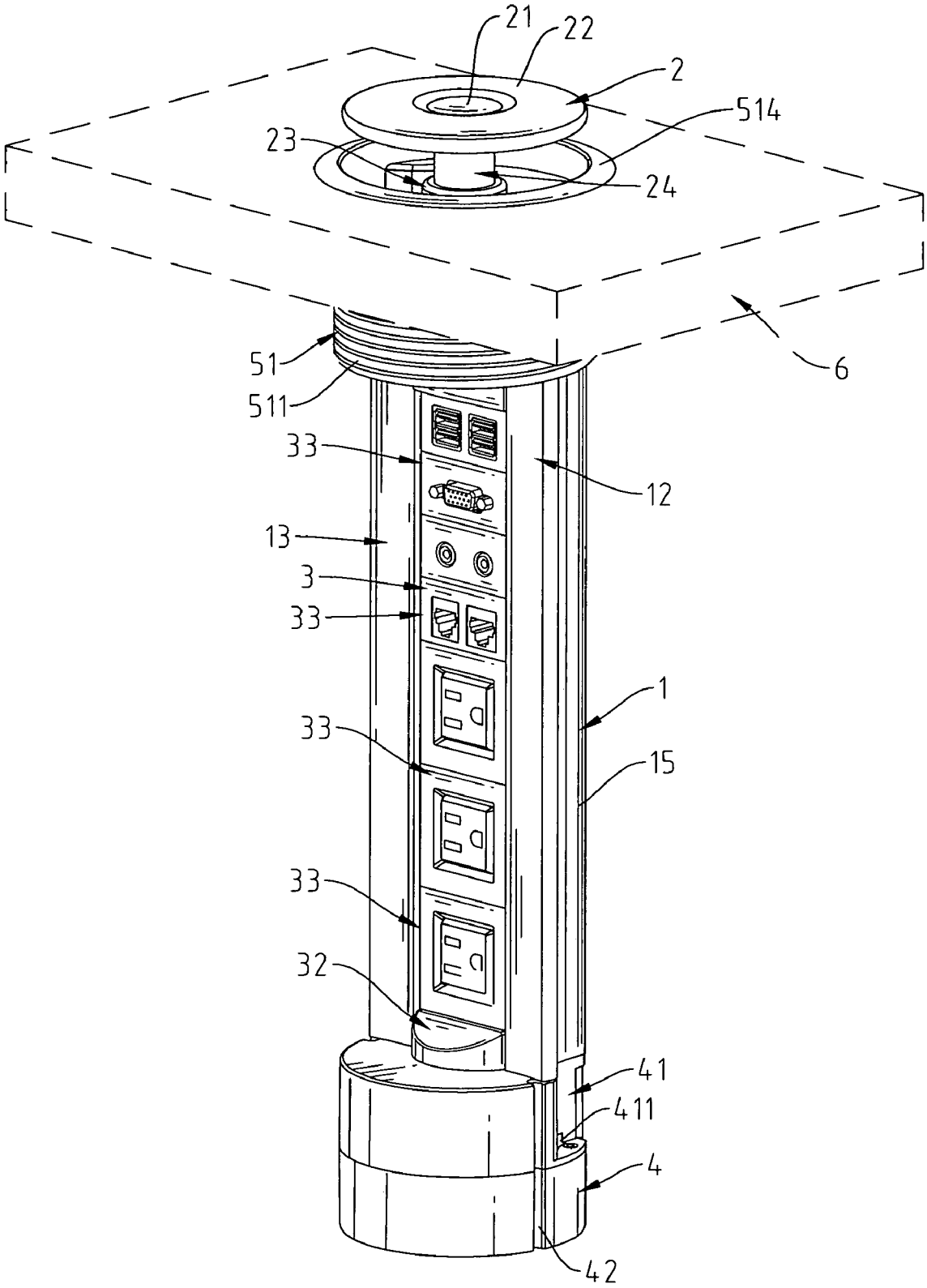
FIG. 7 is a schematic view showing the application status of the modular integrated socket apparatus of the present invention that couples with the table, wherein the pop-up structure is poped up.
Figure 8:
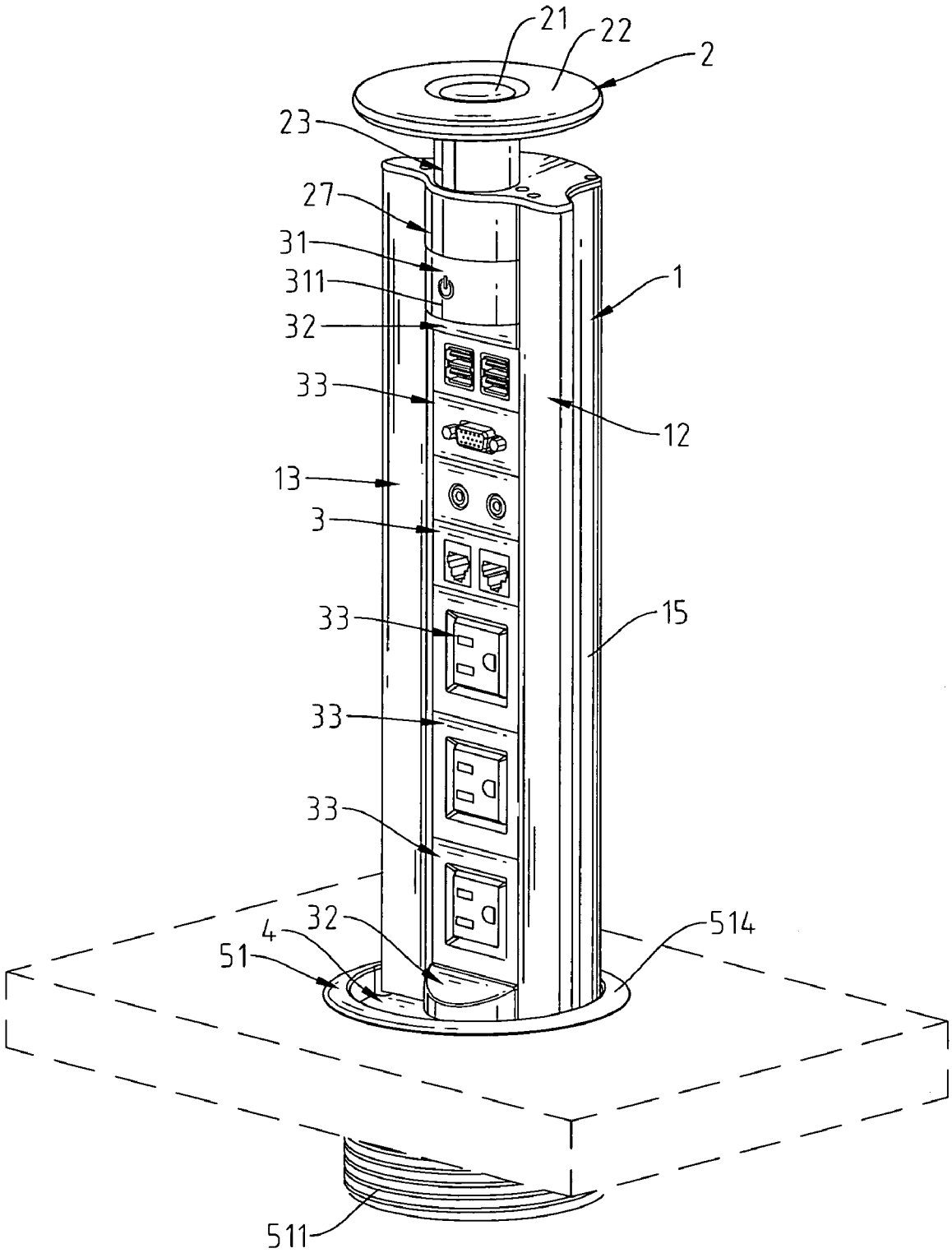
FIG. 8 is a schematic view showing the application status of the modular integrated socket apparatus of the present invention that couples with the table, wherein the pop-up structure is pulled up to locate the shell, the pop-up structure, and the adapter module on the table.

The applications of the aforesaid components are shown in FIG. 6 and FIG. 8. In accordance with the modular integrated socket apparatus of the present invention, a table 6 has a table hole penetrating therethrough for holding the sleeving device 51, whereby the first fixing ring 514 of the sleeving device 51 is flatly placed on the table 6 and the gripping device 52 is screwed onto the outside of the sleeving device 51 for fixing the coupling device 5 in the table hole by use of the first fixing ring 514 and the second fixing ring 523, thereby locating the shell 1, the pop-up structure 2, the adapter module 3, and the connector base 4 on the table.

When in use, the connector socket of the computer peripheral or the power source can be electrically connected with the connector unit 43 via a conducting wire (not shown). In addition, the decorative device 21 or the pull device 22 of the pop-up structure 2 can be pressed to pop up the pull device 22 by a certain distance from the table. Next, the pull device 22 can be pulled up by holding its outer edge so as to allow the shell 1, the pop-up structure 2, and the adapter module 3 to be protrusive from the table, whereby the connectors of computer peripherals such as monitor, microphone, speaker, network cable, USB device, power source, and so on can be inserted into the socket structures 33, and thus the purpose of integrating the sockets is achieved.

What the invention claimed is:

1. A modular integrated socket apparatus comprising:

a shell having two ends, one of the ends being fixed with pop-up structure and a connector base, said shell being attached to an adapter module via the front surface thereof, and said shell being movably sleeved into a coupling device via the outer surface thereof;

said pop-up structure having a pull device, a positioning trench, a guiding device, a positioning device, and an elastic device, said pull device being fixedly connected to one end of said guiding device via the inner surface thereof, said guiding device being sleeved into positioning trench via the outer wall thereof, said positioning trench being fixed on said shell, said guiding device having an opening sleeved onto one end of said positioning device, said positioning device having an opening on the other end for holding said elastic device;

said adapter module being a modularized assembly, and comprising a plurality of socket structures comprising connector sockets for computer peripherals, said socket structures being electrically connected to said connector base and attached to said shell;

said connector base having a connector unit comprising connector sockets for said computer peripherals so as to electrically connect with said computer peripherals; and said coupling device being slidably sleeved onto the outer surfaces of said shell and said connector base via the inner surface thereof, and said coupling device being fixed on a table via the outer surface thereof, and wherein said pull device can be pulled up by holding its outer edge so as to allow said shell, the pop-up structure and adapter module to be protrusive from said table.

2. The modular integrated socket apparatus as claimed in claim 1, wherein at least one positioning slot is inwardly formed on the outer surface of said shell, said connector base has at least one slot on the outer surface thereof corresponding to the bottom end of said positioning slot of said shell, and said slot has a positioning hooking slot at the bottom end thereof.

3. The modular integrated socket apparatus as claimed in claim 1, wherein said adapter module comprises a power controller and a decorative device, said power controller is electrically connected to said connector base for turning on or off a power source, said power controller has a pressing surface on the front surface thereof, said pressing surface has a light-emitting source mounted on the inside thereof, and said decorative device is for partitioning off and decorating said adapter module.

4. The modular integrated socket apparatus as claimed in claim 1, wherein said positioning trench has a plurality of ribs having respective angular slanted rearwards on the inner wall thereof, said positioning trench has a plurality of positioning slots and a plurality of protrusions among said ribs, said guiding device has a plurality of toothed portions circularly at one end thereof on the edge of an opening thereof, said guiding device has a plurality of bumps circularly on the outer surface of an opening thereof, and said bumps are located among said ribs for positioning said guiding device.

* * * * *